US007153190B2

(12) United States Patent
Mavro-Michaelis

(10) Patent No.: US 7,153,190 B2
(45) Date of Patent: Dec. 26, 2006

(54) GRINDING WHEEL MONITORING

(75) Inventor: Daniel Andrew Mavro-Michaelis, West Yorkshire (GB)

(73) Assignee: Cinetic Landis Grinding Limited (GB)

( * ) Notice: Subject to any disclaimer, the term of this patent is extended or adjusted under 35 U.S.C. 154(b) by 0 days.

(21) Appl. No.: 10/537,163

(22) PCT Filed: Dec. 22, 2003

(86) PCT No.: PCT/GB03/05590

§ 371 (c)(1),
(2), (4) Date: May 31, 2005

(87) PCT Pub. No.: WO2004/060611

PCT Pub. Date: Jul. 22, 2004

(65) Prior Publication Data

US 2006/0035565 A1 Feb. 16, 2006

(30) Foreign Application Priority Data

Jan. 2, 2003 (GB) ..... 0300004.9
Mar. 11, 2003 (GB) ..... 0305496.2

(51) Int. Cl.
*B24B 49/00* (2006.01)

(52) U.S. Cl. ..... 451/8; 451/11; 451/56

(58) Field of Classification Search ..... 451/27, 451/72, 51, 11, 49, 5, 8, 9, 10, 56; 125/10; 700/160, 164
See application file for complete search history.

(56) References Cited

U.S. PATENT DOCUMENTS 4,137,677 A * 2/1979 Nedreski ..... 451/11
4,570,389 A * 2/1986 Leitch et al. ..... 451/5
4,628,643 A * 12/1986 Gile et al. ..... 451/5
4,637,169 A * 1/1987 Sigg ..... 451/11
4,653,360 A * 3/1987 Compton ..... 82/18
5,042,206 A * 8/1991 Lambert et al. ..... 451/11
5,044,125 A * 9/1991 Lambert et al. ..... 451/27
6,319,097 B1 * 11/2001 Coverdale et al. ..... 451/49

* cited by examiner

*Primary Examiner*—Jacob K. Ackun, Jr.
(74) *Attorney, Agent, or Firm*—Reising, Ethington, Barnes, Kisselle, P.C.

(57) ABSTRACT

A method of monitoring the wear of a grinding wheel measures the force exerted between the wheel and a workpiece, and generates a warning signal when the measured force exceeds a predetermined threshold value. A signal proportional to the normal grinding force is obtained by measuring the electrical power drawn by the wheelfeed drive motor during grinding. The value of the force proportional signal is compared with corresponding values obtained during the grinding of one or more preceding similar workpieces. Where the grinding wheel includes an annular ridge for grinding an undercut in a workpiece, the ridge portion of the wheel will normally perform more work than the remainder of the wheel, will be liable to the greatest wear, and the force signals will be measured while such portions of the wheel are performing work. The method may be used with electroplated CBN grinding wheels.

19 Claims, 8 Drawing Sheets

GRINDING WHEEL MONITORING

FIELD OF THE INVENTION

This invention concern methods and apparatus for monitoring the failure of grinding wheels especially Electroplated CBN grinding wheels.

BACKGROUND OF THE INVENTION

It is possible to replace the grinding material on the hub of a grinding wheel, particularly to re-electroplate a CBN wheel around the hub and the cost of such a refurbishment of an existing hub is far less than the cost of replacing the wheel in its entirety. However if all of the grinding material is stripped away from any part of the hub during the grinding process, the hub cannot normally be refurbished in this way, and in particular cannot be replated with CBN material. In this event, the wheel has to be scrapped. It should therefore be of financial benefit to an end user of grinding wheels, particularly Electroplated CBN wheels, to be able to predict the point in time just prior to when the grinding material is liable to be stripped from the hub and to allow the machine to be stopped before the wheel is irreparably damaged.

Previously it has been thought that the most suitable method for monitoring a grinding wheel was via the increased in grind power which arises as the wheel wears. Past tests have shown that the increase in grind power over the life of the wheel to be about 50% but most of this increase is found to occur during the machining of the last half to 1% of the normal life expectancy of the wheel. Thus if the normal life of a wheel is expressed in terms of the number of similar workpieces which can be ground by the wheel before it is worn down to the hub, and the normal life is say 4,000 workpieces, then the 50% increase in grind power is only found to occur during the last 20 or 30 workpieces.

This pattern is typical for a grinding wheel performing cylindrical grinding in which the grinding face of the wheel is plain, i.e. the grinding process is substantially uniform over the width of the wheel.

For many grinding processes, the face of the wheel is not plain, but is required to include at least one and sometimes two or three peripheral ridges which it is found tend to wear away more quickly than the remaining surface of the wheel. This is particularly common when grinding sidewalls with undercuts. Each of the rims of the grinding wheel have to remove considerably more metal than the central region of the wheel and the power increase pattern for such a wheel when performing this type of grinding is rather different and there is only a minimal increase in power before the grinding material is completely stripped from the wheel due to the wheel wear occurring disproportionally over the width of the wheel.

It is an object of the present invention to provide an alternative method of monitoring a grinding wheel's performance which provide a reliable warning of when the grinding material, particularly Electroplate CBN material, is found to wear away, even when the wear is excessive and uneven over the width of the wheel.

BRIEF SUMMARY OF THE INVENTION

According to the present invention there is provided a method of monitoring the wear of a grinding wheel comprises the steps of measuring the force exerted between the wheel and the workpiece, measured normal to the grinding face of the wheel at the point of contact between the wheel and workpiece, and generating a warning signal when the measured force exceeds a predetermined threshold value.

A signal indicative of the normal grinding force may be obtained by measuring the force exerted by a wheelfeed drive which in use urges the wheel into grinding engagement with the workpiece.

Where the linear wheelfeed drive includes an electrically powered motor, the torque developed by which is proportional to the normal force between the wheel and workpiece, this will in turn be proportional to the electrical power drawn by the motor during operation, so that an indication of the force between the wheel and workpiece can be obtained by measuring the power demand made by the motor on its power supply.

Where the motor is supplied with electric current from a power supply which maintains a substantially constant EMF, the power demand (and therefore the normal force between wheel and workpiece) will be proportional to the current drawn by the motor from its power supply. In this event a force proportional signal can be obtained by measuring the current flow to the motor during grinding.

In use the value of the force proportional signal obtained during a grinding process on a workpiece can be compared with a corresponding value obtained during the grinding process performed on a preceding similar workpiece, and a warning signal is generated if a current grinding force signal value differs from a preceding grinding force signal value by more than a predetermined amount.

Typically a mean value is computed for the force values measured during each of a succession of workpiece grinds on similar components and the value from the grinding of a current workpiece is compared with the mean value computed from a plurality of preceding workpiece grinds on similar components, and the warning signal is generated if the current force value differs from the mean force value by more than a predetermined amount.

In one arrangement a timing device is reset at one point during each grinding process, and the force measurement is performed for a period of time determined by the timing device following the reset point, and the values of these force measurement signals (or a mean of these force measurement signal. values) is/are compared with force measurement signal values from at least a preceding workpiece grind on a similar component, (or a mean of the force measurement value signals from a plurality of preceding workpiece grinds on similar components).

Preferably the period of time is selected to correspond to the time during which a part of the grinding wheel which is liable to be subjected to the greatest wear during the grinding, is in grinding engagement with the workpiece.

Where the grinding wheel includes a cylindrical surface and an annular ridge for grinding an undercut in a workpiece, it will normally be the ridge which is the part of the wheel surface which performs more work than the remainder of the wheel surface and is therefore liable to the greatest wear during grinding. When using such a wheel the timer is preferably reset at a point during the grinding process, just in advance of when the annular ridge is to come into contact with the workpiece.

Typically the force value signals vary in magnitude during grinding, and preferably therefore it is the peak value of the normal grinding force signal value which is measured and compared with a predetermined value, and the warning signal is generated if the measured peak force value signal exceeds a predetermined value.

Typically the peak force signal value obtained during the grinding of at least one of a succession of similar components is stored and is employed as a predetermined value with which subsequent peak force signal values obtained from grinding each of a succession of similar components, is compared.

Preferably a warning signal is only generated if the peak force signal value for a current grind differs from a stored peak force signal value by more than a predetermined difference.

If generated, a warning signal may be employed to instigate a withdrawal of the wheel from grinding engagement with the workpiece.

In a preferred arrangement data logging of force is triggered X seconds after the start of grinding each workpiece, and disabled Y seconds after the start of grinding, where Y is greater than X.

The invention also provides a method of monitoring grinding wheel wear, in which the instantaneous power demand of a linear motor drive which advances and maintains a grinding wheel in grinding contact with a workpiece is monitored during the same part of a grinding process performed on each of a succession of similar workpieces, and a warning signal is generated immediately when the power demand exceeds a predetermined value.

The warning signal may be employed to sound an alarm to alert a machine operator that a wheel change is required, and/or may be employed to disengage the wheel from the workpiece to prevent further wear occurring, and/or may instigate wheel withdrawal.

Automated wheel replacement may follow by which the worn wheel is automatically demounted from its driving spindle and withdrawn from service, and is replaced with a fresh wheel ready to take over the grinding from the worn wheel.

The method of the invention is of particular use in monitoring the wear of Electroplated CBN grinding wheels, particularly such wheels which are formed with an annular groove or an annular radial protrusion, the profile of which will grind a complementary profile in the surface of a workpiece.

BRIEF DESCRIPTION OF THE SEVERAL VIEWS OF THE DRAWING(S)

The invention will now be described by way of example with reference to the accompanying drawings, in which.

Figure 5A:
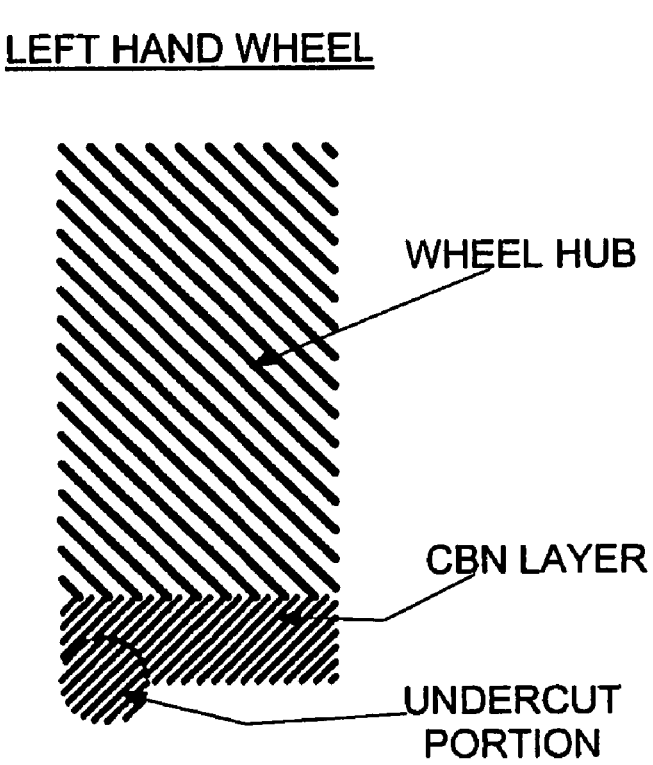
Figure 5B:
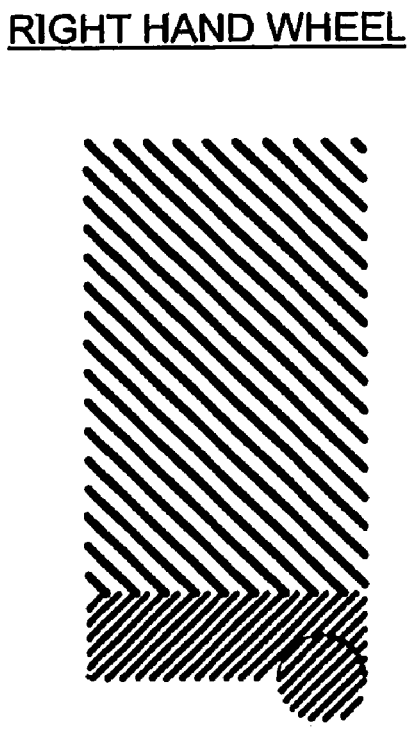
Figure 6:
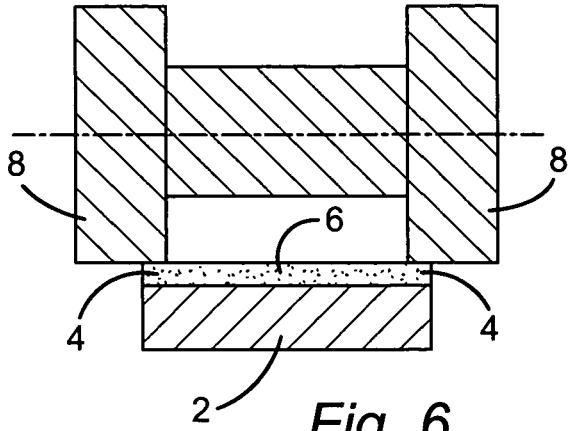
Figure 7:
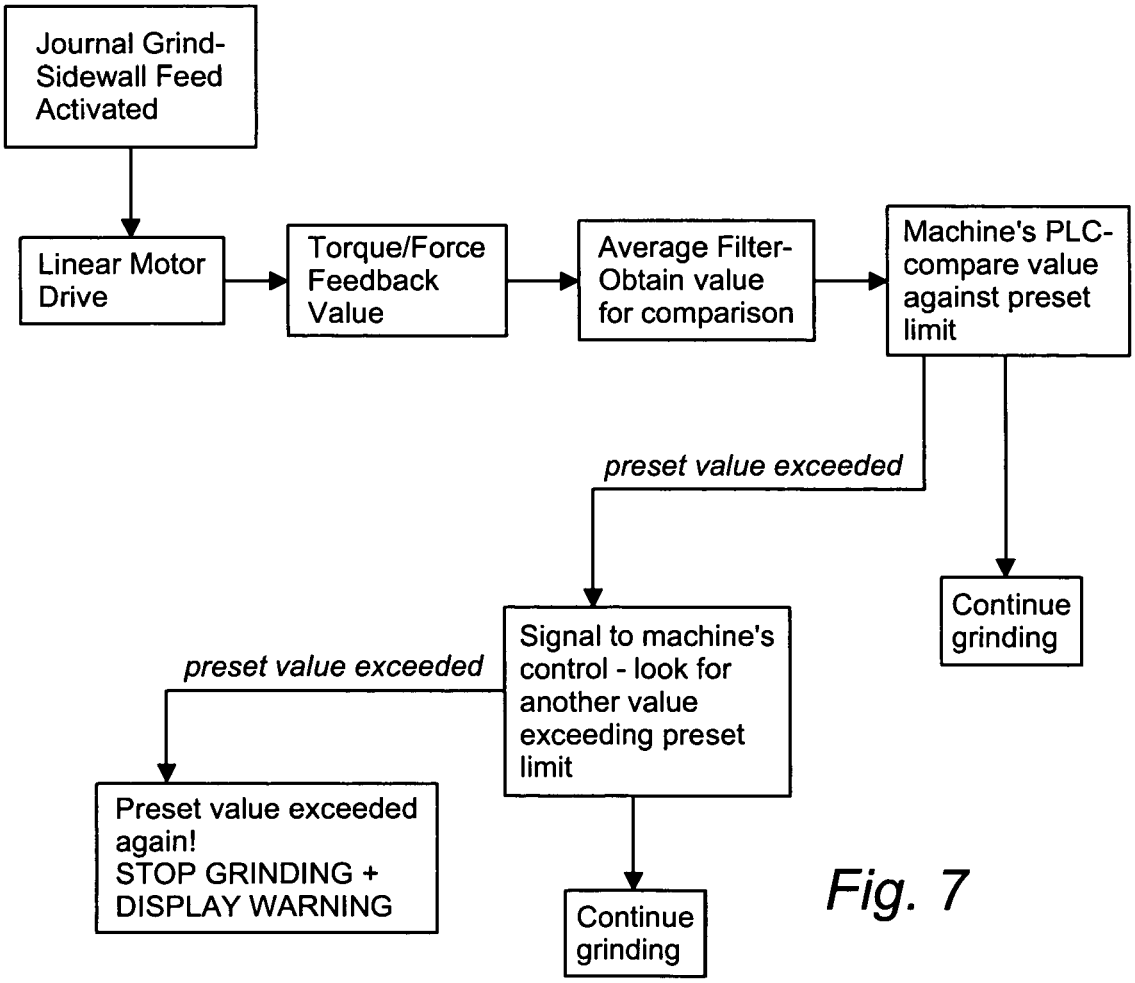
Figure 8:
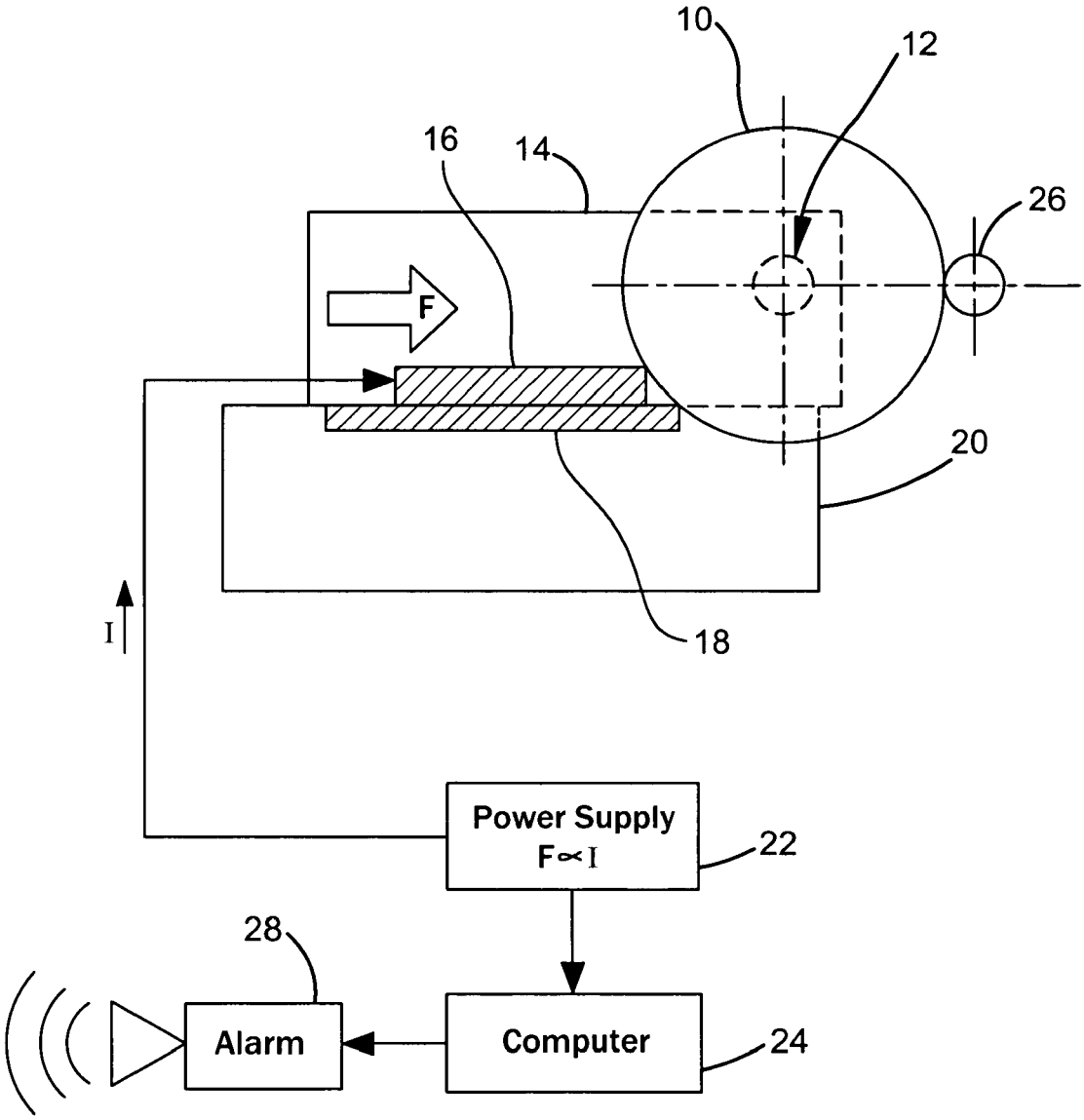
Figure 9:
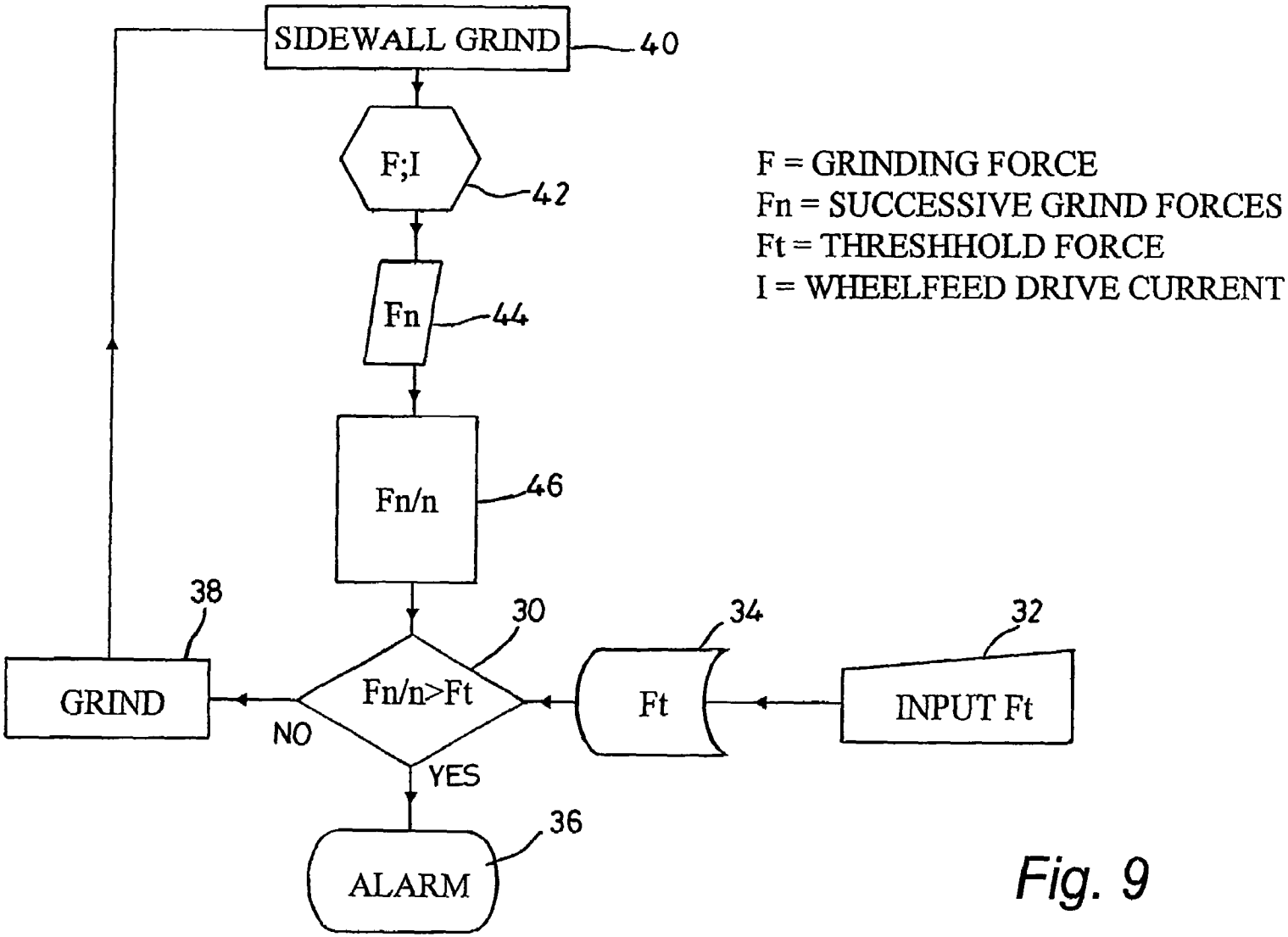

FIG. 5A and FIG. 5B respectively show part of the left hand wheel and part of the right hand wheel of a pair of Electroplate CBN grinding wheels, each having a radial protrusion for grinding an undercut;

FIG. 6 shows a flat faced grinding wheel grinding a workpiece,

FIG. 7 is a flow diagram of a monitoring system embodying the invention,

FIG. 8 is a side view of a wheel engaging a workpiece and shows a linear motor drive for controlling the movement of the wheel, and FIG. 9 is a diagram showing the criteria employed by the computer algorithm.

DETAILED DESCRIPTION OF THE INVENTION

The graphs in FIGS. 1 to 4 were obtained from measuring the normal force during the grinding of a crankshaft crankpin using Electroplated CBN wheels such as shown in FIG. 5. The two wheels were used in succession with each wheel performing half of each plunge. The undercut portion of both wheels performed far more work than the remainder of the wheel and therefore in this situation it is important to monitor the grind in a period where only the undercut portion of the wheel is cutting. The normal force was monitored for the whole of each grind but data was only extracted during the first plunge of each wheel as this was grinding long sidewalls.

Figure 1:
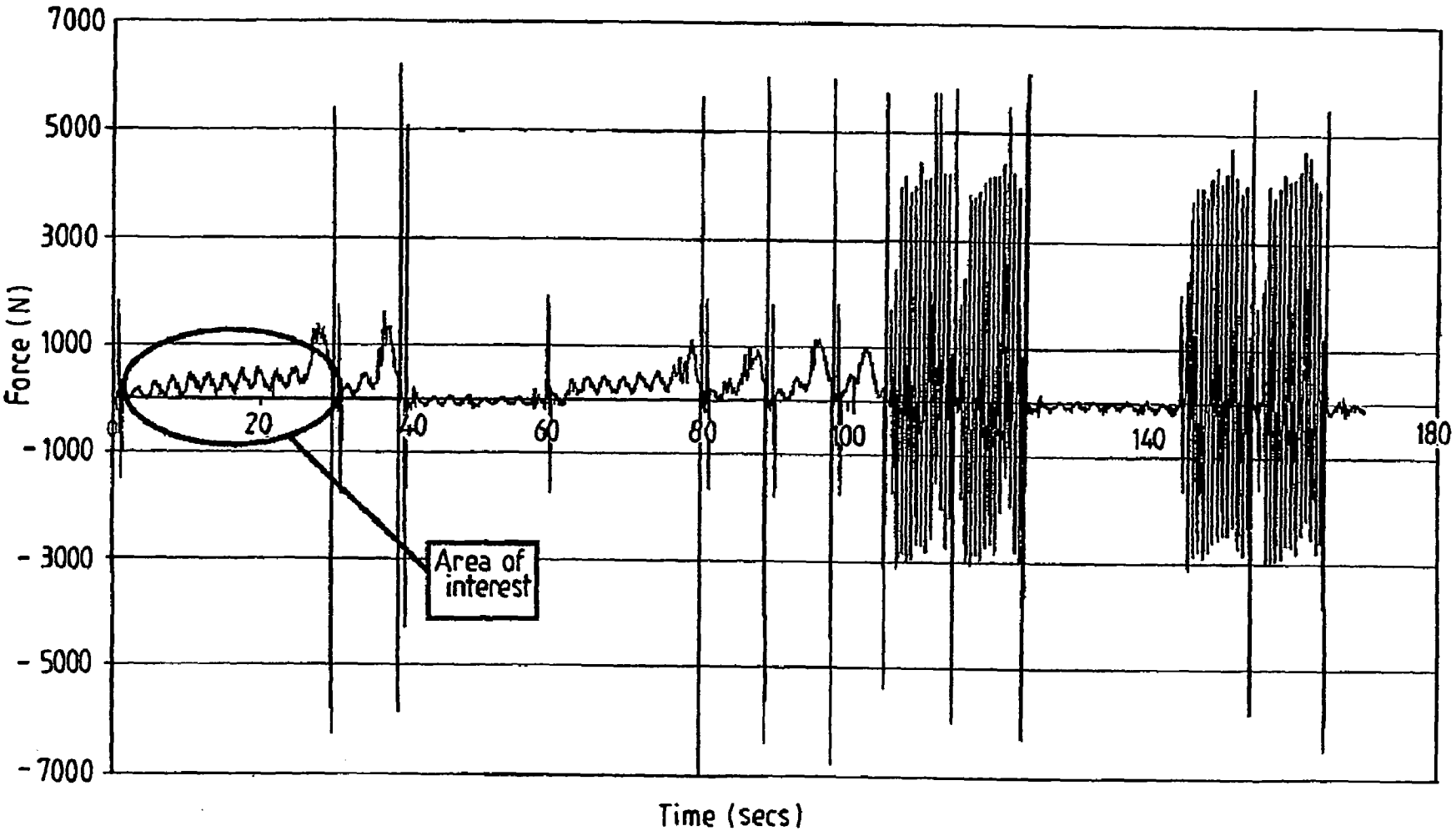
FIG. 1 is a graph showing the normal force acting on one of two grinding wheels for an entire grind cycle.

The graph in FIG. 1 shows the left hand wheel's normal force for the entire grind cycle. The four plunges for the pins are marked due to the cycling effect of the motor force required when grinding a pin. The rapid advances and retracts, in between plunges, can be seen as the large peaks on the normal force plot. The section of the plot that is of most interest can be clearly observed at the start of the grind and is circled in FIG. 1.

Figure 2:
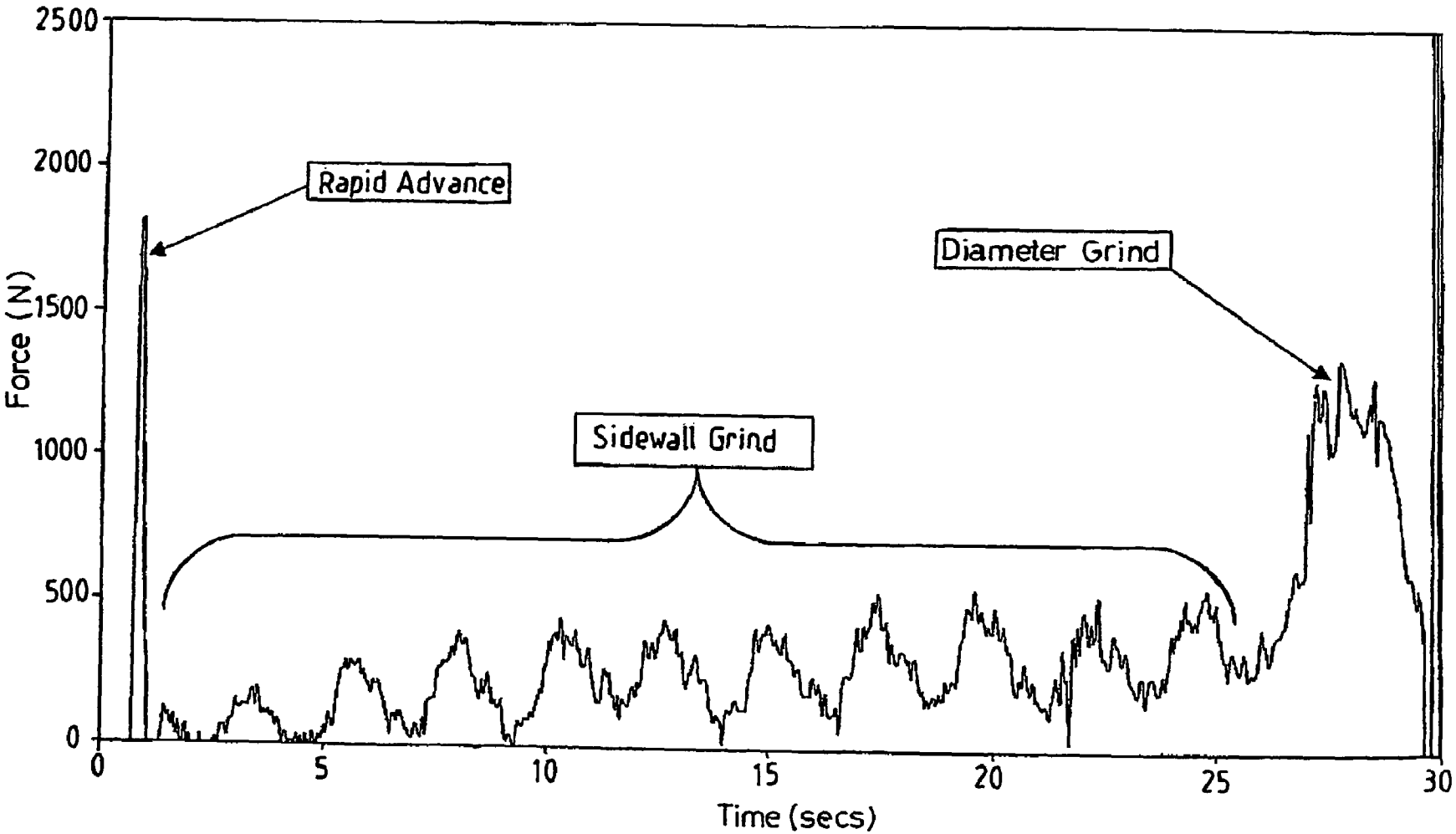
FIG. 2 is an enlargement of the left hand end of the graph of FIG. 1.

The magnified view of the circled section in FIG. 1 is shown in FIG. 2.

The same data was acquired for the right hand wheel over the full grind cycle.

Figure 3:
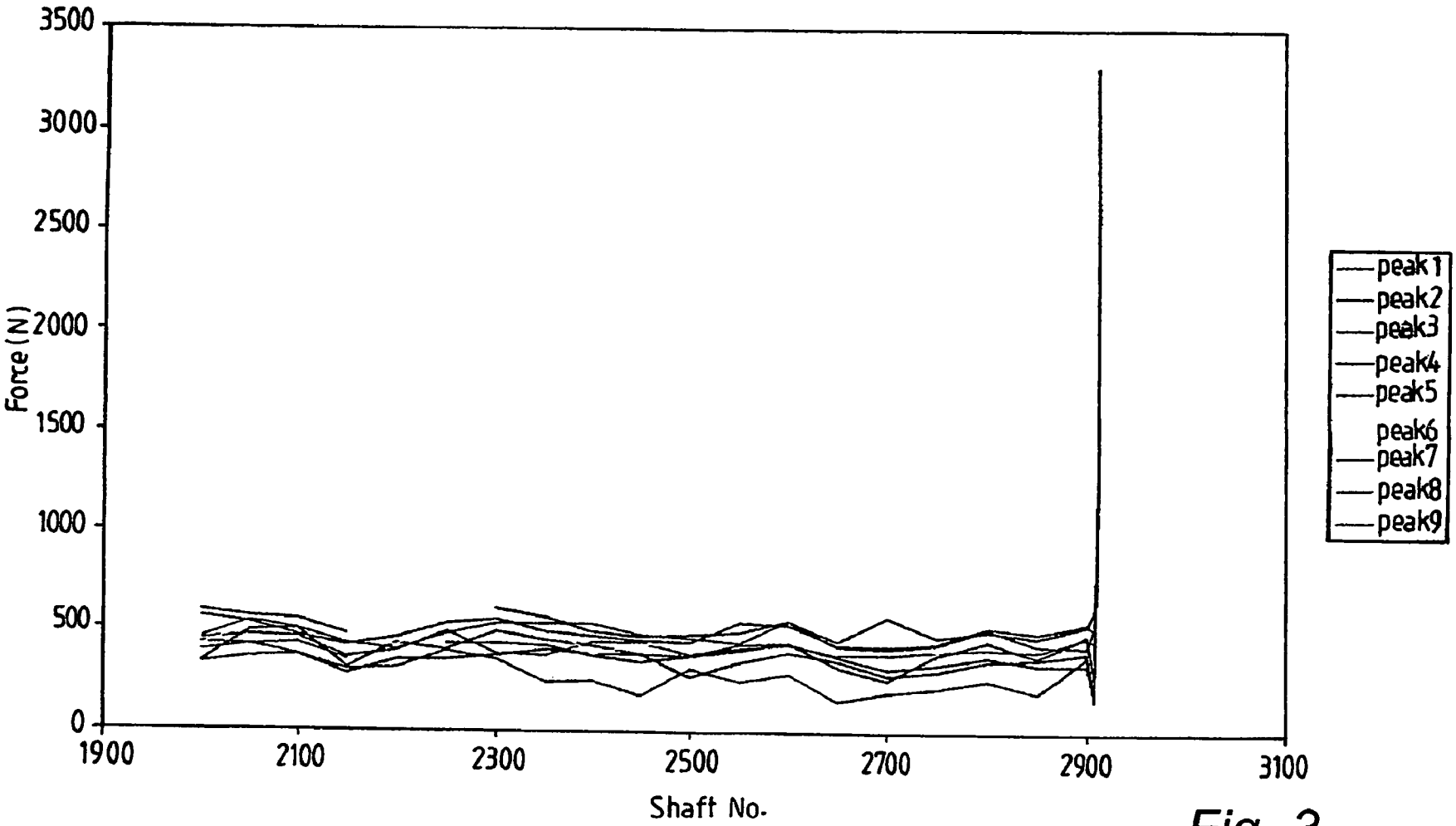
FIG. 3 is a graph showing the nine peak forces generated by a sidewall grind.

In FIG. 2 it will be seen that the sidewall grind, in this case, consists of 11 force cycles followed by the large force required to grind the diameter. This data was taken for every shaft over nearly 1,000 shafts at the end of which the CBN material on the left hand wheel's undercut had become stripped completely to the hub. Graphs were compiled using the values of peak force from the cycles that make up the sidewall grind. The first two force cycles were ignored as they were often very small or non-existent due to the variable sidewall stock. The graph in FIG. 3 shows the 9 peak forces generated by the sidewall grind.

It will be seen that the peak forces for the sidewall grind remain relatively constant over the life of the grinding wheel until just prior to wheel failure where the forces increased dramatically. The X-axis of the graph is the crankshaft number and in this case something in excess of 2,900 crankshafts were ground by the grinding wheels but the plot is only from wheel 1950 through to 2,913 which was when the wheel failed. It will be seen that a huge peak in grinding force occurred just after 2,900 shafts had been ground when the peak normal force which had previously been of the order of 500 Newtons rose to in excess of 3,000 Newtons.

Figure 4:
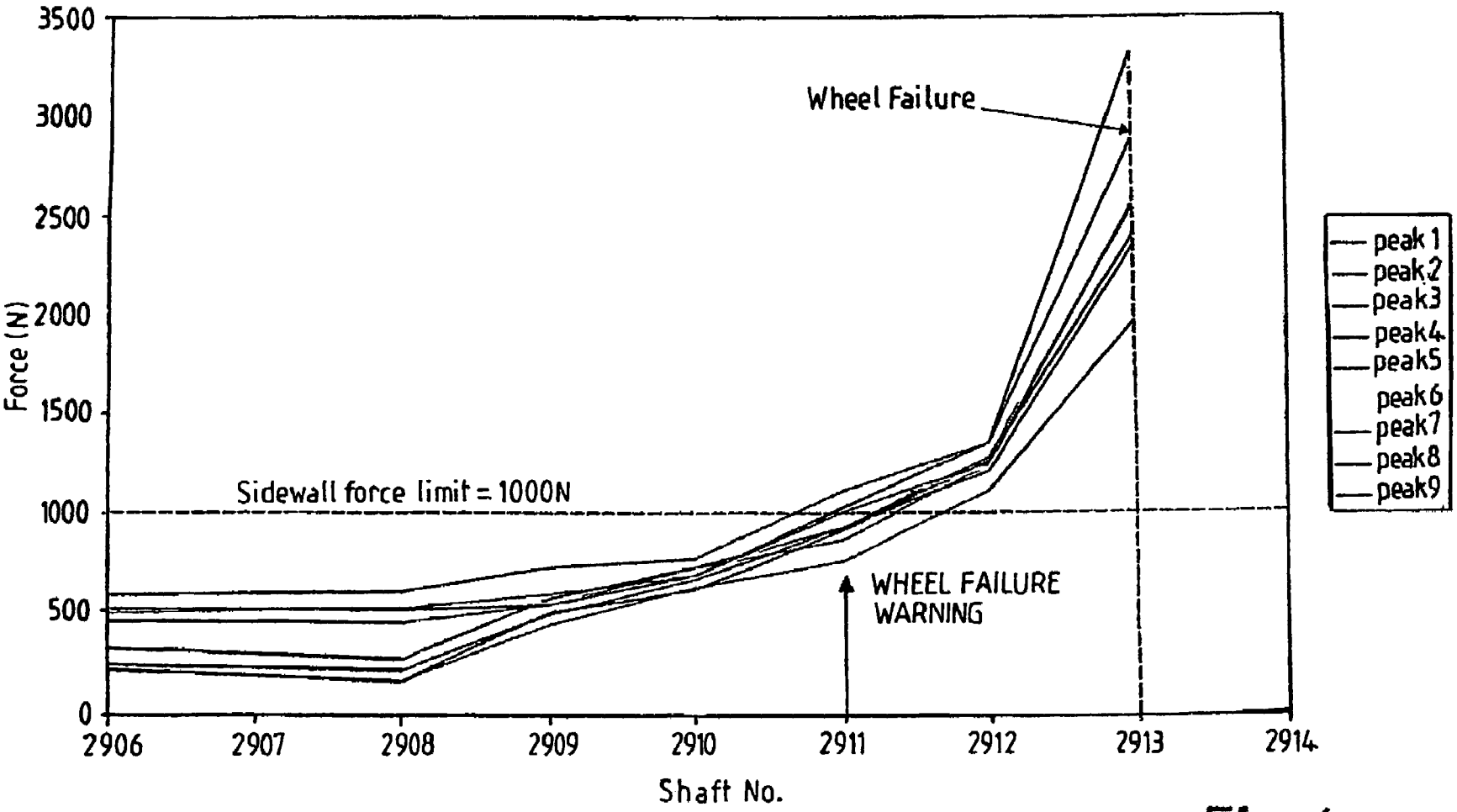
FIG. 4 shows the increase in normal force on the sidewall grind during the last 7 shafts ground using the left hand wheel of a pair of wheels both designed to provide undercuts in a crankpin.

The graph of FIG. 4 shows the increase in the normal force on the sidewall grind, during the last 7 shafts ground, i.e. from 2,006 to 2,013 when wheel failure occurred. From FIG. 4 it will be seen that the sidewall grind forces increased dramatically over the last 5 shafts ground. If a sidewall force limit of 1,000 Newtons had been set, then a warning signal would be displayed or sounded at shaft 2,911 which would have been two shafts prior to complete wheel failure. The amount of Electroplating left on the hub at that stage is probably just sufficient to allow the wheel to be replated and yet to obtain maximum life from the wheel.

Since spurious force peaks can occur during grinding, it is important to monitor the peak normal force during the same portion of each grind cycle since any response to a spurious peak occurring during another part of the grind cycle will cause unwanted stoppages.

As stated previously the invention is equally applicable to flat faced grinding wheels 2 such as shown in FIG. 6. When grinding a workpiece 8 using a flat faced wheel the edge region 4 of the wheel will perform greater amounts of work than the central region 6 of the wheel. The sides of the wheel will therefore fail before the remainder of the wheel. This type of application would therefore still require the windowing approach provided by the invention.

For most grinding operations there will be a rapid advance and a rapid retract of the wheelfeed mechanism. This produces a large force peak that needs to be eliminated from the data being monitored. Again this would require the windowing approach.

FIG. 7 shows by way of a flow diagram the monitoring and decision making steps of a wheel monitoring system embodying the invention. The system assumes a formed CBN wheel to be grinding a formed region of a liner motor wheelfeed.

The monitoring device is brought into play when the side of the wheel (the sidewall) that performs the most work in use. Therefore the monitoring device is activated once the machine starts a sidewall feed for a journal grind.

It is to be noted that wear cannot so readily be monitored when pin grinding since in order to grind a pin the wheelhead must cycle forward and backwards. The forwards and backwards motion masks the grinding force data on the linear motor. At the end of a sidewall feed the monitoring is deactivated.

The signal monitored is the torque/force feedback value, direct from the linear motor drive unit. The values used are a percentage of the maximum linear motor current at standstill. This parameter is monitored every 30 mins and compared against a preset limit value. As the signal monitored tends to have some noise on it, then the value used to compare against the preset limit can be obtained by averaging the values of for example five total sidewall feeds.

If the preset limit is exceeded over the sidewall feeds which are to be averaged, then the system is adapted to look for a second value that exceeds the preset limit. At this stage the device informs the machine control to immediately suspend grinding and display a message regarding imminent wheel failure.

A new wheel can then be mounted and grinding can continue.

The removed wheel can be sent for replating.

The flow diagram of FIG. 7 shows the process just described.

FIG. 8 shows a wheel 10 carried on a spindle 12 of a wheel-head 14 itself carried by the primary 16 of a linear motor drive, the secondary of which 18 is secured to the machine bed 20. Current I to the primary 16 is supplied from a power supply 22 which supplies a constant EMF and is itself under the control of the machine computer 24. Grinding force between wheel 12 and workpiece 26 is proportional to the current I and since this value is available to the computer 24 the latter can generate an instantaneous numerical value F proportional to I, to yield a succession of values of F. Since it is important for the value of F to correspond to the same point in each grind, the computer 24 is programmed to calculate the value of F at a predetermined stage during the grinding of each of a succession of similar components. When journal grinding crank pins of crankshafts for example, in which the wheel is employed to plunge grind between side walls at opposite ends of a crank pin, the value of F is calculated during the plunge grind since as mentioned in relation to FIG. 6, that is when wheel wear is most likely to first become evident.

To this end the windowing is effective to prevent the value of F from being calculated while the flat outer face of the wheel is being used to grind the pin, after the plunge grind step, and likewise during the fast advance and retraction of the wheel prior to and after grinding engagement.

Using experimental or wheel manufacturers data, the threshold value for F (i.e. $F_t$) is input into the computer 24 and compared with the force value F and if the threshold value is exceeded a signal is generated by the computer to instigate an audible alarm 28. If desired the same signal may be employed to prevent the grinding of any more workpieces such as 26 by inhibiting the electric current to the linear motor 16, 18 after the current grinding cycle has been completed and the drive 16, 18 has retracted the wheelhead and disengaged the wheel from the workpiece.

The algorithm performed by the programmed computer 24 is shown in FIG. 9.

In order to smooth out unexplained peaks the force value compared by the algorithm comparison step 30 is a running average computed by summing the latest value of F with the previous m values of F and dividing the new value by n (where n=(m+1)).

The threshold value $F_t$ is input via a data input device 32 and stored in the computer memory at 34 and compared with the running average in 30.

If $F_n/n$ is greater than $F_t$ the comparison algorithm is satisfied logic produces a YES signal to generate an Alarm signal 36.

If $F_n/n$ is less than or equal to $F_t$ the criterion is not satisfied and the logic produces a Grind signal 28 which enables the next grind to take place.

The windowing of the monitored value of I (and therefore the updating of the value of F) is controlled so as only to occur when sidewall grinding is occurring, and to this end the algorithm includes an input corresponding to when this is occurring at 40, which controls the computation of F for I in step 42 and likewise the summing of the values of F to produce $F_n$ in 44. The division of $F_n$ by n is performed in 46 to provide the value of $F_n/n$ which is to be compared with $F_t$ in 30.

The invention claimed is:

1. A method of predicting imminent grinding wheel failure by monitoring the wear of a grinding wheel in use, comprising the steps of:

measuring the force exerted by a wheelfeed drive which in use urges the wheel into grinding engagement with a workpiece so as to obtain a signal indicative of the force exerted between the wheel and workpiece normal to the grinding face of the wheel at the point of contact between the wheel and workpiece;

generating a warning signal when the value of the signal exceeds a predetermined threshold value indicating imminent grinding wheel failure;

wherein the wheelfeed drive includes an electrically powered motor, the torque developed by which is proportional to the normal force between the wheel and workpiece, and which is in turn proportional to the electrical power drawn by the motor during operation, whereby an indication of the force between wheel and workpiece is obtained by measuring the power demand made by the motor on its power supply;

comparing the value of the force proportional signal obtained during a grinding process on a workpiece with a corresponding value obtained during the grinding process performed on a preceding similar workpiece; and generating the warning signal if a current grinding force signal value differs from a preceding grinding force signal value by more than a predetermined amount.

2. A method as claimed in claim 1 wherein a mean value is computed for the force values measured during each of a succession of workpiece grinds on similar components and the value from the grinding of a current workpiece is compared with the mean value computed from a plurality of preceding workpiece grinds on similar components, and the warning signal is generated if the current force value differs from the mean force value by more than a predetermined amount.

3. A method as claimed in claim 1 wherein a timing device is reset at one point during each grinding process, and the force measurement is performed for a period of time determined by the timing device following the reset point, and the values of these force measurement signals are compared with force measurement signal values from at least a preceding workpiece grind on a similar component.

4. A method as claimed in claim 3 wherein the period of time is selected to correspond to the time during that a part of the grinding wheel which is liable to be subjected to the greatest wear during the grinding, is in grinding engagement with the workpiece.

5. A method as claimed in claim 4 wherein the grinding wheel includes a cylindrical surface and an annular ridge for grinding an undercut in a workpiece, and it is the ridge that is the part of the wheel surface that performs more work than the remainder of the wheel surface and is therefore liable to the greatest wear during grinding, and the timer is reset at a point during the grinding process, just in advance of when the annular ridge is to come into contact with the workpiece.

6. A method as claimed in claim 1 wherein the force value signals vary in magnitude during grinding, and the peak value of the normal grinding force signal value is measured and compared with a predetermined value, and the warning signal is generated if the measured peak force value signal exceeds a predetermined value.

7. A method as claimed in claim 6 wherein the peak force signal value during the grinding of at least one of a succession of similar components is stored and is employed as a predetermined value with which a subsequent peak force signal value obtained from grinding another of the succession of similar components, is compared.

8. A method as claimed in claim 6 in which the warning signal is only generated if the peak force signal value for a current grind differs from a stored peak force signal value by more than a predetermined difference.

9. A method as claimed in claim 1 wherein the warning signal is employed to instigate a withdrawal of the wheel from grinding engagement with the workpiece.

10. A method as claimed in claim 1 wherein data logging of force is triggered X seconds after the start of grinding each workpiece, and disabled Y seconds after the start of grinding, where Y is greater than X.

11. A method of monitoring grinding wheel wear, in which the instantaneous power demand of a linear motor drive that advances and maintains a grinding wheel in grinding contact with a workpiece is monitored during identical parts of a grinding process performed on each of a succession of similar workpieces, and a warning signal is generated immediately when the power demand exceeds a predetermined value.

12. A method as claimed in claim 11 wherein the warning signal is employed either to sound an alarm to alert a machine operator that a wheel change is required, or to disengage the wheel from the workpiece to prevent further wear occurring, or to instigate wheel withdrawal.

13. A method as claimed in claim 11 wherein the warning signal instigates automated wheel replacement in which the wheel is automatically withdrawn from grinding engagement, automatically demounted from its driving spindle and withdrawn from service, and automatically replaced with a fresh wheel ready to take over the grinding from the worn wheel.

14. A method as claimed in claim 11 wherein the monitoring is used to monitor the wear of Electroplated CBN grinding wheels.

15. A method as claimed in claim 14 wherein the wheels are formed with an annular groove or an annular radial protrusion, the profile of which will grind a complementary profile in the surface of a workpiece.

16. A method of monitoring the wear of a grinding wheel in use, comprising the steps of:

measuring the force exerted by a wheelfeed drive which in use urges the wheel into grinding engagement with a workpiece so as to obtain a signal indicative of the force exerted between the wheel and workpiece normal to the grinding face of the wheel at the point of contact between the wheel and workpiece;

generating a warning signal when the value of the signal exceeds a predetermined threshold value;

wherein the wheelfeed drive includes an electrically powered motor, the torque developed by which is proportional to the normal force between the wheel and workpiece, and which is in turn proportional to the electrical power drawn by the motor during operation, whereby an indication of the force between wheel and workpiece is obtained by measuring the power demand made by the motor on its power supply;

supplying the motor with electric current from a power supply which maintains a substantially constant EMF, so that the power demand (and therefore the normal force between wheel and workpiece) is proportional to the current drawn by the motor from its power supply;

obtaining a force proportional signal by measuring the current flow to the motor during grinding;

comparing the value of the force proportional signal obtained during a grinding process on a workpiece with a corresponding value obtained during the grinding process performed on a preceding similar workpiece; and generating a warning signal if a current grinding force signal value differs from a preceding grinding force signal value by more than a predetermined amount.

17. A method of predicting imminent grinding wheel failure by monitoring the wear of a grinding wheel in use in which a wheelfeed drive includes an electric motor for advancing the grinding wheel into a workpiece, the method comprising the steps of:

measuring the normal grinding force between the wheel and the workpiece, wherein the normal grinding force is measured normal to the grinding face of the wheel at the point of contact between the wheel and workpiece;

obtaining a signal indicative of the normal grinding force by measuring the force exerted by the wheelfeed drive;

obtaining a signal proportional to force exerted by the wheelfeed drive by measuring the torque developed by the electric motor;

obtaining a signal proportional to the torque developed by the electric motor by measuring the electrical power drawn by the electric motor during operation, whereby an indication of the normal grinding force between the wheel and workpiece can be obtained by measuring the power demand made by the motor on its power supply; and, generating a warning signal when the measured force exceeds a predetermined threshold value indicating imminent grinding wheel failure.

18. A method of predicting imminent grinding wheel failure by monitoring the wear of a grinding wheel in use in which a wheelfeed drive urges the wheel into grinding engagement with a workpiece, the method comprising the steps of:

measuring the force exerted by the wheelfeed drive to obtain a present force signal indicative of the force exerted between the wheel and workpiece normal to the grinding face of the wheel at the point of contact between the wheel and workpiece, comparing the value of the present force signal obtained during a grinding process on a workpiece with a corresponding preceding force signal obtained during the grinding process performed on a preceding similar workpiece, and generating a warning signal if a present force signal value differs from the preceding force signal value by more than a predetermined amount indicating imminent grinding wheel failure.

19. A method of predicting imminent grinding wheel failure by monitoring the wear of a grinding wheel in use in which a wheelfeed drive includes an electric motor for advancing the grinding wheel into a workpiece, the method comprising the steps of:

measuring the normal grinding force between the wheel and the workpiece, wherein the normal grinding force is measured normal to the grinding face of the wheel at the point of contact between the wheel and workpiece;

obtaining a signal indicative of the normal grinding force by measuring the force exerted by the wheelfeed drive;

obtaining a signal proportional to force exerted by the wheelfeed drive by measuring the torque developed by the electric motor;

obtaining a signal proportional to the torque developed by the electric motor by measuring the electrical power drawn by the electric motor during operation, whereby an indication of the normal grinding force between the wheel and workpiece can be obtained by measuring the power demand made by the motor on its power supply; and, comparing the value of the signal indicative of force obtained during a present grinding process on a workpiece with a corresponding signal obtained during a previous grinding process performed on a preceding similar workpiece; and, generating a warning signal if the current signal indicative of force differs from a preceding signal indicative of force by more than a predetermined amount indicating imminent grinding wheel failure.

* * * * *